US009204674B2

(12) United States Patent
Bujold

(10) Patent No.: US 9,204,674 B2
(45) Date of Patent: Dec. 8, 2015

(54) PERSONAL COOLING SYSTEM AND METHOD

(76) Inventor: Alain Bujold, Saint-Jean sur Richelieu (CA)

( * ) Notice: Subject to any disclaimer, the term of this patent is extended or adjusted under 35 U.S.C. 154(b) by 932 days.

(21) Appl. No.: 13/514,118

(22) PCT Filed: Sep. 21, 2010

(86) PCT No.: PCT/CA2010/001467

§ 371 (c)(1),
(2), (4) Date: Aug. 20, 2012

(87) PCT Pub. No.: WO2011/032288

PCT Pub. Date: Mar. 24, 2011

(65) Prior Publication Data

US 2012/0315128 A1 Dec. 13, 2012

Related U.S. Application Data

(60) Provisional application No. 61/244,316, filed on Sep. 21, 2009.

(51) Int. Cl.

| | |
|---|---|
| ***F03B 13/00*** | (2006.01) |
| ***A41D 13/002*** | (2006.01) |
| ***A45F 3/00*** | (2006.01) |
| ***A45F 3/14*** | (2006.01) |
| *A45F 3/12* | (2006.01) |
| *A45F 3/16* | (2006.01) |

(52) U.S. Cl.

CPC ..... *A41D 13/0025* (2013.01); *A45F 3/00* (2013.01); *A45F 3/12* (2013.01); *A45F 3/14* (2013.01); *A45F 2003/003* (2013.01); *A45F 2003/125* (2013.01); *A45F 2003/166* (2013.01)

(58) Field of Classification Search

CPC ... F04D 13/068; F04D 15/066; F04D 19/002; F04D 25/0673; F04D 25/084; F04D 29/58; A45F 2003/125

See application file for complete search history.

(56) References Cited

U.S. PATENT DOCUMENTS

| | | | | |
|---|---|---|---|---|
| 6,257,235 | B1 * | 7/2001 | Bowen | 128/206.21 |
| 6,779,592 | B1 * | 8/2004 | Ichigaya | 165/46 |
| 7,249,464 | B1 | 7/2007 | Watson | |
| 7,272,946 | B2 * | 9/2007 | Ichigaya | 62/259.3 |
| 2005/0246826 | A1 * | 11/2005 | McCarter et al. | 2/458 |

FOREIGN PATENT DOCUMENTS

| | | | | |
|---|---|---|---|---|
| EP | 0490347 | A1 * | 6/1992 | A41D 13/002 |
| EP | 1552759 | A1 | 7/2005 | |
| WO | 2006068072 | A1 | 6/2006 | |

OTHER PUBLICATIONS

"Supplementary Europen Search Report" of EP 10816534.1.

* cited by examiner

*Primary Examiner* — Igor Kershteyn

(74) *Attorney, Agent, or Firm* — Damien Calvet; Brouillette & Partners

(57) ABSTRACT

A portable system for promoting heat removal and cooling of a human body is provided. The cooling system generally comprises a pair of panels, configured to be mounted to the chest and to the back of a human body and such as to define a space between themselves and the human body. The panels are each provided with at least one fan configured to draw the air and water vapor circulating in the space between the panels and the human body and to direct it away from the human body, effectively cooling the body.

14 Claims, 3 Drawing Sheets

PERSONAL COOLING SYSTEM AND METHOD

CROSS-REFERENCE TO RELATED APPLICATIONS

The present patent application claims the benefits of priority of commonly assigned U.S. Provisional Patent Application No. 61/244,316, entitled "Personal Cooling System and Method", and filed at the United States Patent and Trademark Office on Sep. 21, 2009; the content of which is incorporated herein by reference.

FIELD OF THE INVENTION

The present invention generally relates to personal cooling systems and methods for promoting heat removal from human bodies.

BACKGROUND OF THE INVENTION

Cooling human bodies has long been a need in many circumstances. For instances, firemen, law enforcement personnel, military personnel, construction workers, petroleum industry workers, smelting plant workers and boiler operators generally work in often hot and humid environments. For these people, having a portable system for cooling their bodies is particularly useful and sometimes even necessary.

To address this need, several portable cooling systems have been proposed throughout the years. Prior art examples of portable cooling systems can be found in U.S. Pat. Nos. 4,964,282; 5,217,408; 5,564,124; 5,970,519; 6,257,011 and 6,260,201; and more recently in U.S. Patent Application Publication Nos. 2006/0026743; 2006/0174392 and 2007/0199124.

Still, the common thread among the prior art systems is that they generally all blow air toward the body. Though this approach does generally work, it has some shortcomings. For instance, the air blown toward the body can be equally hot and/or humid or even hotter and/or more humid than the air surrounding the body. Hence, despite ongoing development, there is still a need for a novel personal cooling system which mitigates the shortcomings of the prior art.

SUMMARY OF THE INVENTION

The shortcomings of prior art personal cooling systems are generally mitigated by providing a novel personal cooling system wherein the cooling of the human body is effected by drawing air and water vapour from the human body and by directing them away therefrom. The present cooling system integrates biomimetic principles, which apply natural phenomena to the study of engineering and design, to ensure a better body thermoregulation. Indeed, as the human body naturally expels heat through sweating, the present cooling system accelerates this natural phenomenon to cool the human body in a more effective way.

Hence, a cooling system in accordance with the principles of the present invention typically comprises a pair of panels adapted to be respectively mounted to the chest and the back of a human body. The panels are further configured to define a space between themselves and the human body when they are mounted thereto. The space so generated allows the air and the water vapour to circulate between the panels and the human body.

Each panel is provided with at least one and preferably several fans or blowers. The fans are mounted to the panels such as to normally draw the air and the water vapour circulating in the space defined between the panel and the body and to direct and propel them toward the exterior and away from the human body, effectively cooling the body.

The fans are typically battery-powered and their speed is preferably adjustable, allowing the user to adjust cooling rate of the system according to its cooling needs.

The skilled addressee will understand that the personal cooling system of the present invention works in collaboration with the natural body-regulating process of the human body. Indeed, in order to cool itself, the human body naturally releases excess inner heat by expelling hot water in the form of sweat, until the proper inner temperature is reached, as naturally determined by the body. The personal cooling system in accordance with the principles of the present invention works with this natural process by further drawing the air and water vapour circulating near the human body, as a result of the evaporation of the sweat, and by directing them away therefrom.

It is to be understood that in the prior art, the cooling systems typically do not control the temperature of the air blown toward the body. Consequently, should a significant temperature difference exist between the air blown toward the body and the surface temperature of the body, the body could be exposed to a temperature shock and thereby suffer significant adverse side effects.

Hence, by drawing air from the surface of the body instead of blowing air toward the body as in prior art systems, the personal cooling system in accordance with the principles of the present invention relies on the capacity of the body to settle itself at its own inner temperature and at its own rhythm, so as to avoid any detrimental and adverse side effects that may otherwise result from an outside temperature impact.

Understandably, other and further advantages of the present invention will be obvious upon an understanding of the illustrative embodiments about to be described or will be indicated in the appended claims, and various advantages not referred to herein will occur to one skilled in the art upon employment of the invention in practice. The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel personal cooling system will be described hereinafter. Although the invention is described in terms of specific illustrative embodiments, it is to be understood that the embodiments described herein are by way of example only and that the scope of the invention is not intended to be limited thereby.

The system and method in accordance with the principles of the present invention are designed to reduce the human skin body temperature so that a person wearing the system may more safely withstand adverse heat conditions. The system may also be used simply to increase the comfort of this person in hot environments.

Figure 1:
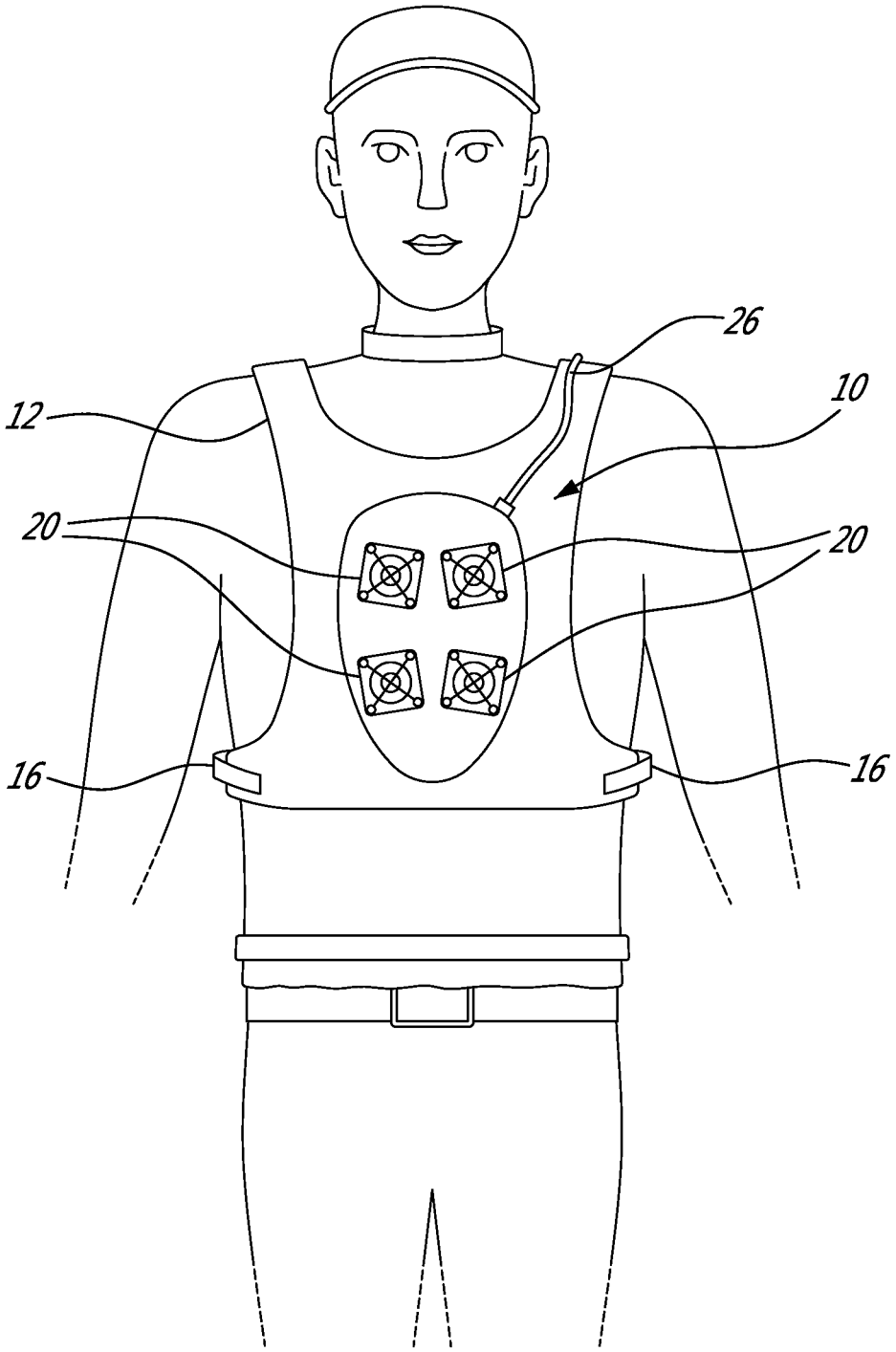
FIG. 1 is a front view of an embodiment of a personal cooling system in accordance with the principles of the present invention, as worn by a user.
Figure 2:
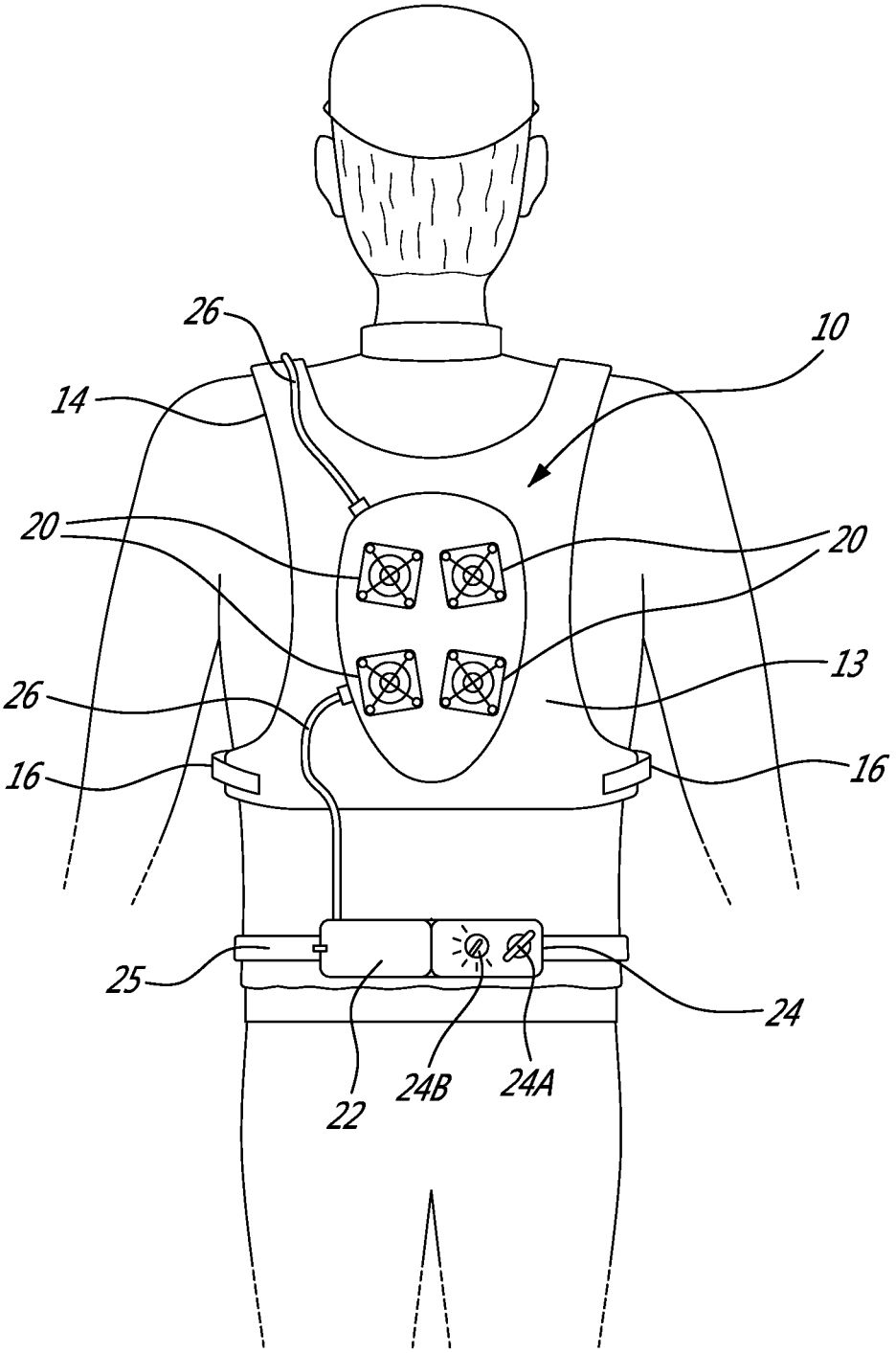
FIG. 2 is a rear view of the personal cooling system shown in FIG. 1, as worn by a user.
Figure 3:
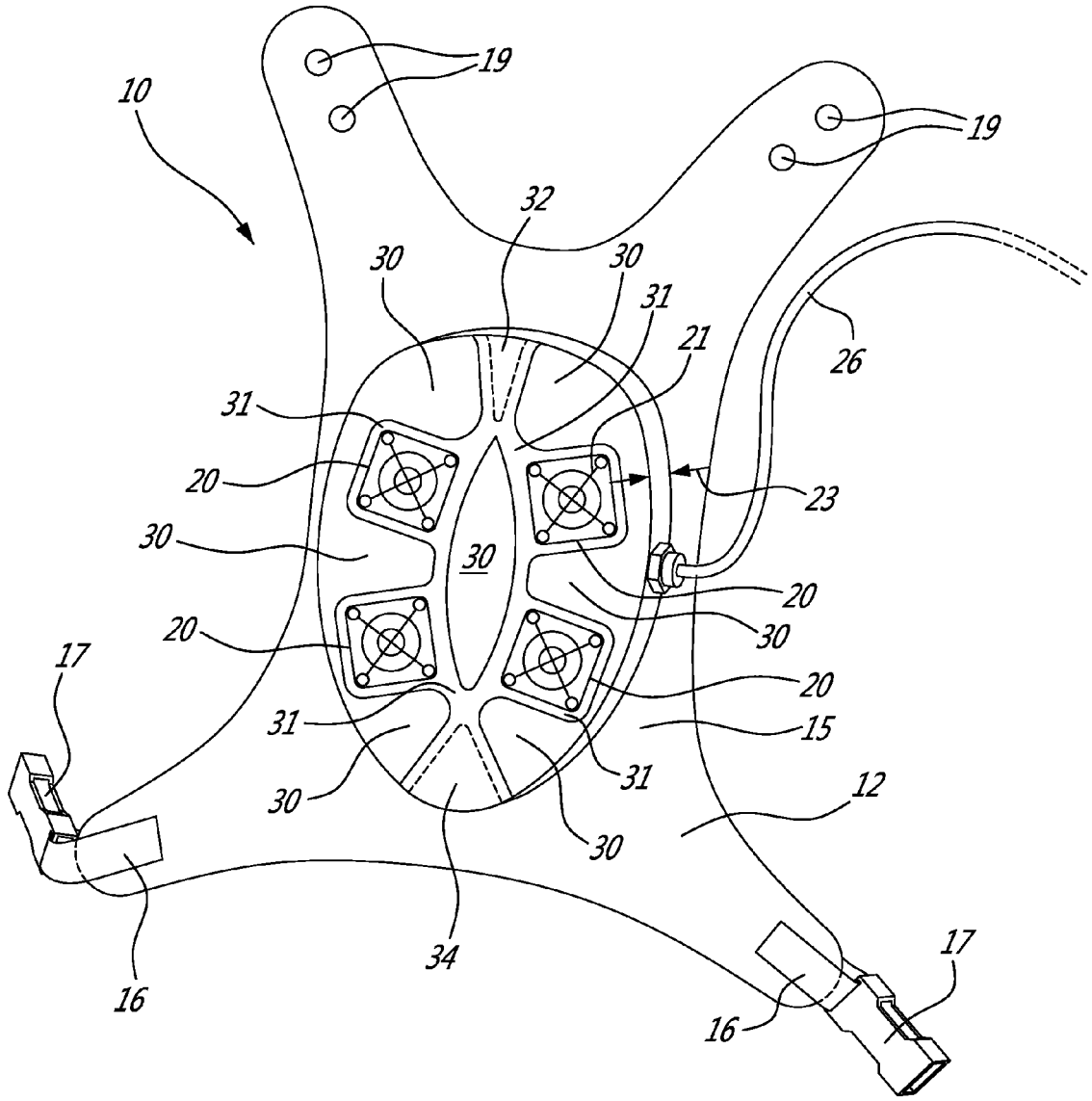
FIG. 3 is a perspective view of the inner side of one panel of the personal cooling system shown in FIG. 1.

FIGS. 1 to 3 show an embodiment of a personal cooling system 10 in accordance with the principles of the present invention. The system 10 comprises at least one panel 12, 14 generally designed to be worn by a user under protective clothing such as an overcoat or a vest or any other kind of clothing. Each one of the panels 12, 14 is preferably configured to be worn either on the chest or on the back of the user. The user may wear a light shirt or any similar kind of garment between his or her skin and the panel or panels 12, 14. It is also possible to use the panels 12, 14 over more than one layer of clothing or even in direct contact with the skin. Still, the layer or layers of clothing between the panels 12 and 14 and the body of the user must allow for the circulation of air and water vapour.

To maximize the efficiency of the cooling, a complete system 10 preferably comprises two panels 12, 14, namely a chest panel 12 and a back panel 14. Both of them are connected together using straps 16, or similar elements, and fasteners such as, but not limited to, snaps 17 and buttons 19 (see FIG. 3). The panels 12 and 14 can be manufactured in various sizes and shapes to better fit a wide variety of people. In addition, the straps and fasteners can be configured to provide a certain level of adjustment in order to allow the user to properly adjust the system 10 over its body.

Though they are generally similar, it should be noted that the chest and back panels 12, 14 are not necessarily identical.

The panels 12 and 14 are preferably made of a material which is light and has some degree of flexibility. It can be made of foam, such as Plastazote® from Zotefoams plc, or other polymeric materials. Using a material with good heat absorption capabilities may contribute to remove more heat from the body of the user.

As depicted in the figures, panels 12 and 14 are provided with at least one electric fan 20 that normally draws air from the region between each panel 12, 14 and the body of the user, and sends that air on the other side of the panel 12, 14, away from the body. For improved efficiency, a plurality of fans 20 are used, each fan 20 covering a selected area of the panel 12, 14.

As shown in FIG. 2, the fans 20 are preferably powered by mean of a portable electric power source 22, for instance a set of dry cells or rechargeable batteries, and corresponding electric cables 26. The electrical efficiency of the fans 20 should be very high to improve the autonomy of the power source 22. It is also possible to use any other kind of electric source to power the fans 20, depending on the requirements of the system 10. For instance, if the user works at a fixed station, the fans 20 may be connected to a fixed electrical power outlet.

The fans 20 are preferably controlled using a control system 24 allowing different levels of cooling to be selected. One button 24*a* (e.g. a switch) of the illustrated embodiment in FIG. 2 is for powering the control system 24, the other button 24*b* (e.g. a potentiometer) is for controlling the speed of the fans 20. When working with a portable electric source 22, the autonomy will be somewhat proportional to the amount of air drawn by the fans 20. Typically, each fan 20 would draw between about 1 to about 50 CFM of air. The user would use the setting corresponding to his or her need, and the required autonomy.

In alternate embodiments, the control system 24 could comprise two buttons 24*b* for independently controlling the fan speed of the chest panel fans 20 and the back panel fans 20.

As best shown in FIG. 2, the power source 22 and the control system 24 are mounted on a belt 25 worn by the user. In the present embodiment, the belt 25 is distinct from the panels 12 and 14. However, in alternate embodiments, the power source 22 and the control system 24 could be directly provided or mounted on one or both panels 12 and 14.

Each fan 20 typically comprises a motor, a set of blades connected to the motor and a protection element, preferably on each side of the fan 20, to insure that the fan 20 is free to rotate within its cavity. The protection element is preferably in the form of a grille 21 best shown in FIG. 3. In addition, as best illustrated in FIG. 3, the fans 20 are preferably located within the thickness 23 of the panels 12 and 14.

As best shown in the figures, the panels 12 and 14 each comprises an outer side 13 facing away from the user and an inner side 15 facing the user. As illustrated in FIG. 3, the inner side 15 comprises a plurality of raised protruding portions or protrusions 30 which define channels 31 therebetween and which space the panels 12 and 14 from the body of the user such as to promote a more efficient airflow around the inlet of the fans 20, thus on the inner side 15 facing the body of the user. These raised portions 30 may be in the form of semi-hemispheric members, or any other suitable shape, positioned in a spaced apart relationship around the fans 20. The channels 31 formed by the disposition and configuration of the raised portions 30 also promote a more efficient air flow. In that sense, some of the channels 31 are preferably located adjacent and/or around the fans 20 such that the fans 20 can more easily draw the air from the space between the panels 12 and 14 and the body.

Understandably, other shape and configurations of raised protruding portions 30 and channels 31 can be used as well. Similar or identical structures may also be present on the opposite side 13 of the panels 12 and 14.

As shown in FIG. 3, some of the raised portions 30 can be provided on detachable parts 32, 34 to be attached on the main portion of the panel 12 (or 14), if required.

Overall, the personal cooling system 10 influences the rate of evaporation of water (i.e. sweat) from the skin of the body of its user, thereby accelerating the phase change of the sweat from liquid to vapour. The suction created in the space between the panels 12, 14 and the body of the user also draws more humidity and heat away from the body. This results in that the cooling of the body of the user being more efficient than in prior art systems.

The present embodiment of the personal cooling system 10 can be used by many different persons and in many different situations. Examples of persons that can benefit from using this system 10 include firemen, law enforcement personnel, military personnel, construction workers, petroleum industry workers, smelting plant workers or boiler operators.

Typically, in use, the user will take the chest panel 12 and the back panel 14 and will attach them together over his or her body. If necessary, the user will also attach the belt 25 and connect all the electric cables 26. The user will then be able to power on the fans 20 to cool his or her body.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A cooling system for cooling a human body comprising a chest and a back, the cooling system comprising:

at least one panel configured to be mounted to one of the chest and the back of the human body, the at least one panel comprising;

an outer side configured to face away from the human body, an inner side configured to face the human body, the outer and inner sides of the panel defining a thickness of the panel; the inner side further defining a space between the panel and the human body when the panel is mounted on the chest or the back of the human body, the space allowing air and water vapour naturally produced by the human body to circulate between the panel and the human body; and a plurality of fans mounted within the thickness of the panel, each fan being configured such that, when powered, the fans draw said air and water vapour from the space between the panel and the human body toward the outer side of the at least one panel and away from the human body; and the cooling system further comprising a power source operatively connected to the fans for providing power thereto.

2. A cooling system as claimed in claim 1, wherein the space between the inner side of each panel and the human body is provided with spaced apart protrusions defining channels therebetween.

3. A cooling system as claimed in claim 2, wherein at least some of the channels are located around the at least one fan.

4. A cooling system as claimed in claim 1, wherein the inner side of the at least one panel is provided with spaced apart protrusions defining channels therebetween.

5. A cooling system as claimed in claim 4, wherein at least some of the protrusions are located around the plurality of fans.

6. A cooling system as claimed in claim 1, further comprising a control system, the control system being operatively connected to the at least one fan for selectively controlling a speed of the at least one fan.

7. A cooling system as claimed in claim 1, wherein the cooling system comprises a plurality of panels.

8. A cooling system as claimed in claim 7, wherein each of the panels comprises fasteners such that the panels are configured to be attached together via the fasteners.

9. A method for cooling a human body, the method comprising the steps of:

a) wearing a cooling system as claimed in claim 1;

b) powering on the at least one first fan.

10. A cooling system suitable for being worn by a user having a body comprising a chest and a back, the cooling system comprising:

a) a first panel being suitably configured to be mounted to the chest of the body, the first panel comprising an outer side configured to face away from the body, an inner side configured to face the chest of the body, the outer and inner sides of the first panel defining a thickness of the first panel; the inner side further defining a first space between the first panel and the chest when the panel is mounted on the chest of the user, the space allowing air and water vapour naturally produced by the body to circulate between the first panel and the chest; and a plurality of first fans mounted within the thickness of the first panel configured such that, when powered, the first fans draw said air and water vapour from the first space between the first panel and the chest towards the outer side of the first panel and away from the body;

b) a second panel attachable to the first panel and being suitably configured to be mounted to the back of the body, the second panel comprising an outer side configured to face away from the body, an inner side configured to face the back of the body, the outer and inner sides of the second panel defining a thickness of the second panel; the inner side further defining a second space between the second panel and the back when the second panel is mounted on the back of the user, the second space allowing air and water vapour naturally produced by the body to circulate between the second panel and the back; and a plurality of second fans mounted within the thickness of the second panel configured such that, when powered, the second fans draw said air and water vapour from the second space between the second panel and the back towards the outer side of the second panel and away from the body; and c) a power source mountable to the body and operatively connected to the at least one first fan and to the at least one second fan for providing power thereto.

11. A cooling system as claimed in claim 10, wherein the first space between the inner side of the first panel and the chest comprises first protruding portions defining first channels therebetween, and wherein the second space between the inner side of the second panel and the back comprises second protruding portions defining second channels therebetween.

12. A cooling system as claimed in claim 10, wherein at least some of the first channels are located adjacent to the first fans, and wherein at least some of the second channels are located adjacent to the second fans.

13. A method for cooling a human body, the method comprising the steps of:

a) wearing a cooling system as claimed in claim 10;

b) powering on the at least one first fan and the at least one second fan.

14. A cooling system as claimed in claim 10, further comprising a control system, the control system being operatively connected to the at least one first fan and to the at least one second fan for selectively controlling a speed of the at least one first fan and at least one second fan.

* * * * *